US005960838A

United States Patent [19]

Tietz et al.

[11] Patent Number: 5,960,838

[45] Date of Patent: Oct. 5, 1999

[54] VALVE FOR ADJUSTABLE FILLING CHAMBER

[75] Inventors: Felix Tietz, Hamburg; Wolfgang Wilke, Hoisdorf, both of Germany

[73] Assignee: Crown Simplimatic Incorporated, Lynchburg, Va.

[21] Appl. No.: 09/032,577

[22] Filed: Feb. 27, 1998

[51] Int. Cl.[6] ..... B65B 1/04

[52] U.S. Cl. ..... 141/89; 141/91; 141/144; 141/145; 141/146; 141/147; 222/148; 134/169 R

[58] Field of Search ..... 141/89–91, 144–147, 141/152; 222/148, 380, 64; 139/169 R

[56] References Cited

U.S. PATENT DOCUMENTS

| | | | |
|---|---|---|---|
| 1,490,923 | 4/1924 | Hansen . | |
| 1,572,149 | 2/1926 | Kiefer . | |
| 2,626,738 | 1/1953 | Nordquist | 141/89 |
| 2,807,213 | 9/1957 | Rosen . | |
| 3,693,640 | 9/1972 | Wettlen et al. | 134/169 R |
| 4,060,109 | 11/1977 | Sotoma . | |
| 4,405,061 | 9/1983 | Bergandy | 222/21 |
| 4,569,378 | 2/1986 | Bergandy . | |
| 4,708,269 | 11/1987 | Willerding | 222/148 |
| 5,230,383 | 7/1993 | Engler | 222/148 |

*Primary Examiner*—Steven O. Douglas
*Assistant Examiner*—Timothy L. Maust
*Attorney, Agent, or Firm*—Howard & Howard

[57] ABSTRACT

A circular filling machine 10 rotates a plurality of filling units 20 through a plurality of actuator stations 30 and 32. The filling machine 10 is characterized by an adjustment valve, including a seal 38 and a positioning member 40, for determining the quantity of the material 14 to be filled into the chamber 34. The seal 38 is biased downwardly against the positioning member 40 by a spring 50 to hold the seal 38against the inside of the chamber 34 in the closed position. The seal 38 may be moved vertically out of engagement with the positioning member 40 to an open position by a cam 62 and cam follower 64 to allow cleaning material 37 to flush the entire chamber 34. In addition, the vertical operating level of the seal 38 and positioning member 40 may be adjusted vertically in unison to adjust the level to which the chamber 34 may be filled to accommodate containers 11 of various different volumes. The positioning member 40 and the seal 38 both depend from a platform 52 by tubular columns 54 and 56 so that the vertical adjustment is accomplished by rotation of a threaded screw 58 threadedly engaging the platform 52.

20 Claims, 6 Drawing Sheets

68
60
78
52
20
66
58
56
38
84
80
76
16
86
36
11

60
78
52
20
58
66
56
34
84
76
80
36
86
16
88
11

68
78
60
20
52
58
66
56
84
34
76
80
86
36
16
88
11

68
60
20
78
34
37
80
84
36
16
86
88
82

20

52
72
50
64
70
42
58
62
74
34
80
84
66
56
54
44
40
48
38
46
76

20
72
52

70
50
42
62
74
64
58
84
34
80
66
56
48
54
44
38
46
40
76

VALVE FOR ADJUSTABLE FILLING CHAMBER

BACKGROUND OF THE INVENTION

1. Field of the Invention

The subject invention relates to a high speed filling machine having a plurality of filling units with adjustable delivery volumes for filling containers of various different volumes from run to run.

2. Description of the Prior Art

Filling machines in which containers are moved in a circle and filled from filling units are well known in the art. Included in the prior art are machines in which the filling units have adjustable volumes for filling containers of different volumes. Such machines are illustrated in U.S. Pat. Nos. 2,807,213; 4,060,109; and 4,569,378.

Of course, it is necessary to clean or flush the machine between setups or runs of different materials, i.e., beverages. Typically, a flushing fluid is circulated through the machine. However, since a seal is perfected in the machine to establish the quantity or volume of material for filling, it is difficult to flush the machine with cleaning material on both sides of that seal.

SUMMARY OF THE INVENTION AND ADVANTAGES

The invention provides a method of cleaning a machine for filling containers comprising the steps of moving a plurality of chambers through a plurality of actuator stations, filling the chambers through the bottoms thereof, sealing each chamber at a predetermined level to prevent material to fill above the predetermined level, and filling a container from each chamber with the material filled to the predetermined level therein. The method is characterized by periodically unsealing each chamber to allow cleaning material to flow downwardly past the predetermined level for cleaning the chamber above and below the predetermined level.

The invention may be practiced by a filling machine comprising a plurality of individual filling units each including a working chamber with a container filling mechanism at the bottom of each chamber for receiving material through the filling mechanism from a supply of material for filling the chamber. A common drive moves the filling units through a plurality of actuator stations. The machine is characterized by a valve for determining the quantity of the material to be filled into the chamber by preventing the flow of material upwardly past the valve and for allowing cleaning material to flow downwardly past the valve.

Accordingly, the invention allows the filling volume to be changed from run to run for containers of different volumes by an adjustable valve which presents a seal, yet allows cleaning by flushing with cleaning material above and below the valve as the seal of the valve is released to allow the cleaning material to flow past the valve.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
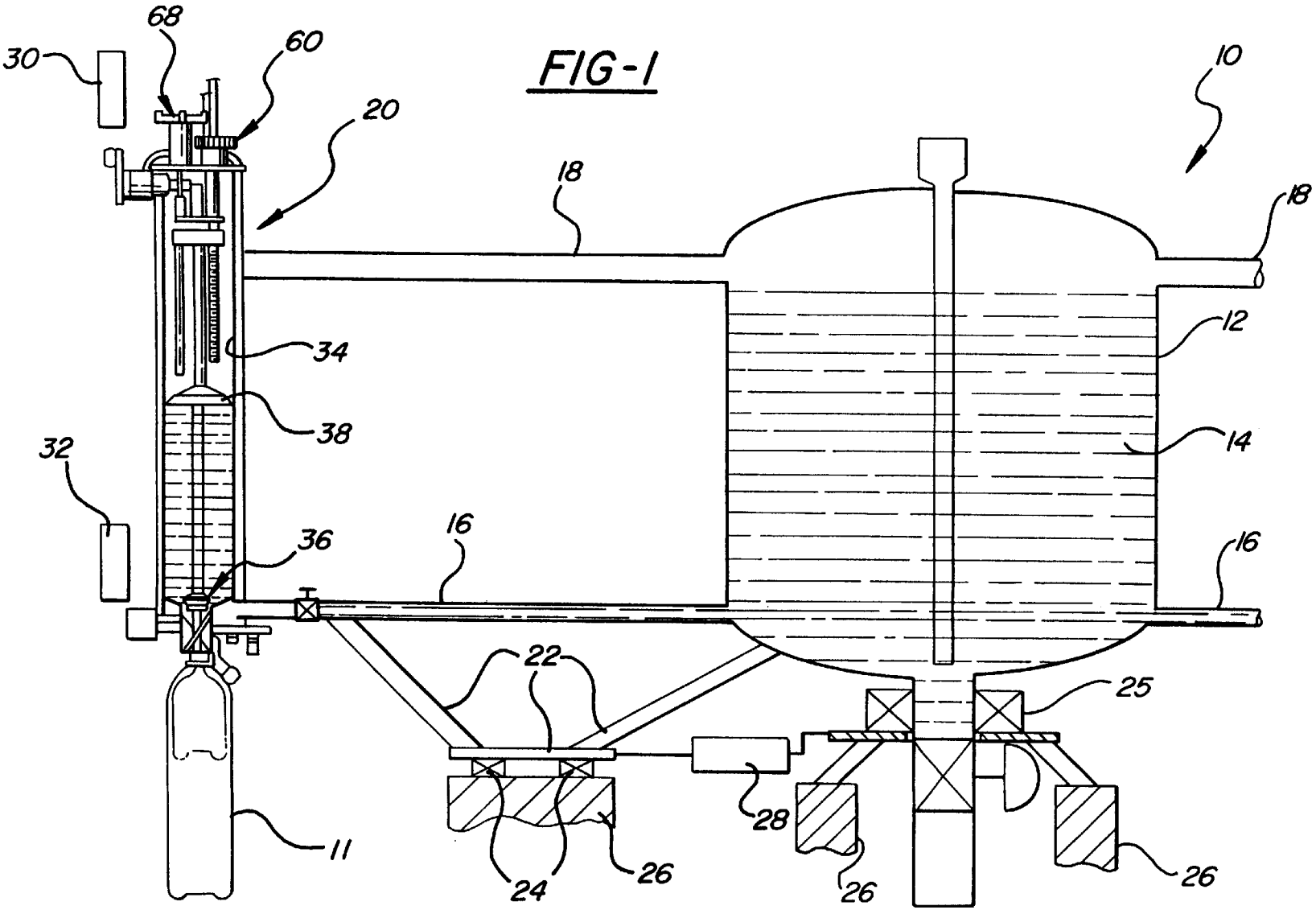
FIG. 1 is a schematic view showing one half of a circular filling machine employing the filling unit of the subject invention.

Referring to the Figures, wherein like numerals indicate like or corresponding parts throughout the several views, a filling machine is generally shown at 10 in FIG. 1 for filling containers, such as large bottles 11 or small bottles shown in phantom in FIG. 1. As is well known in the art, the filling machine is circular with a centrally disposed tank 12 for feeding material 14, in the form of a beverage, through feed lines 16 and return lines 18 extending radially like spokes from the tank 12 to a plurality of filling units, one of which is generally indicated at 20. The filling machine 10 is circular and is supported on a framework 22 which is, in turn, supported through bearing assemblies 24 on a foundation 26. In addition or alternatively, a center bearing 25 may support the tank 12 on the foundation 26. A common drive 28 is included for moving, i.e., rotating, the filling units 20 through a plurality of actuator stations, two of which are shown schematically at 30 and 32 in FIG. 1.

Each of the filling units 20 includes a working chamber 34 defined by an elongated cylinder and a container filling mechanism 36 disposed at the bottom of each chamber 34 for controlling the flow of material 14 from the tank 12 and the fill line 16, which represent a supply of material for filling the chamber 34 with material through the filling mechanism 36.

Figure 7:
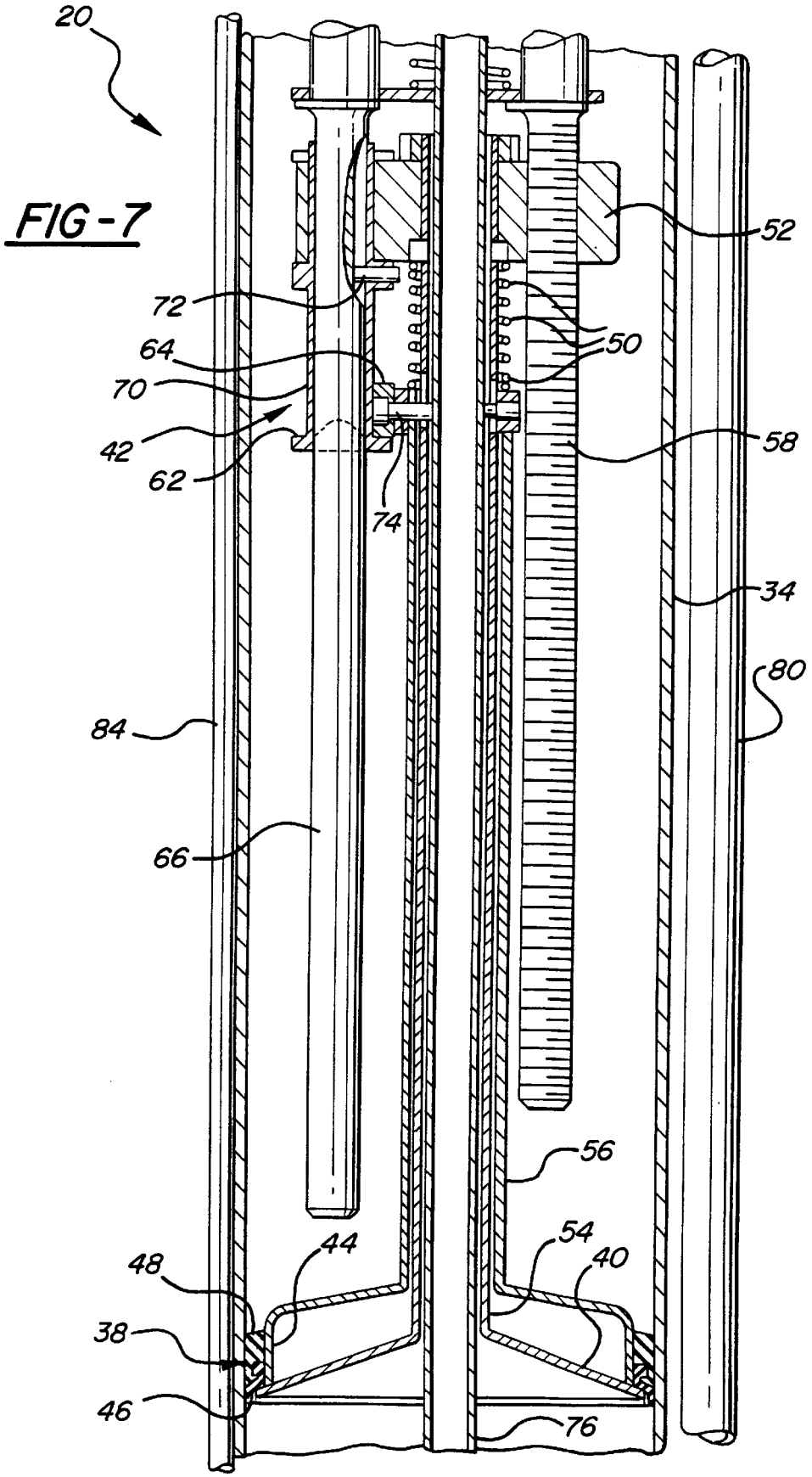
FIG. 7 is an enlarged fragmentary and cross sectional view of the filling unit and showing the adjustment valve of the subject assembly in the closed position.
Figure 8:
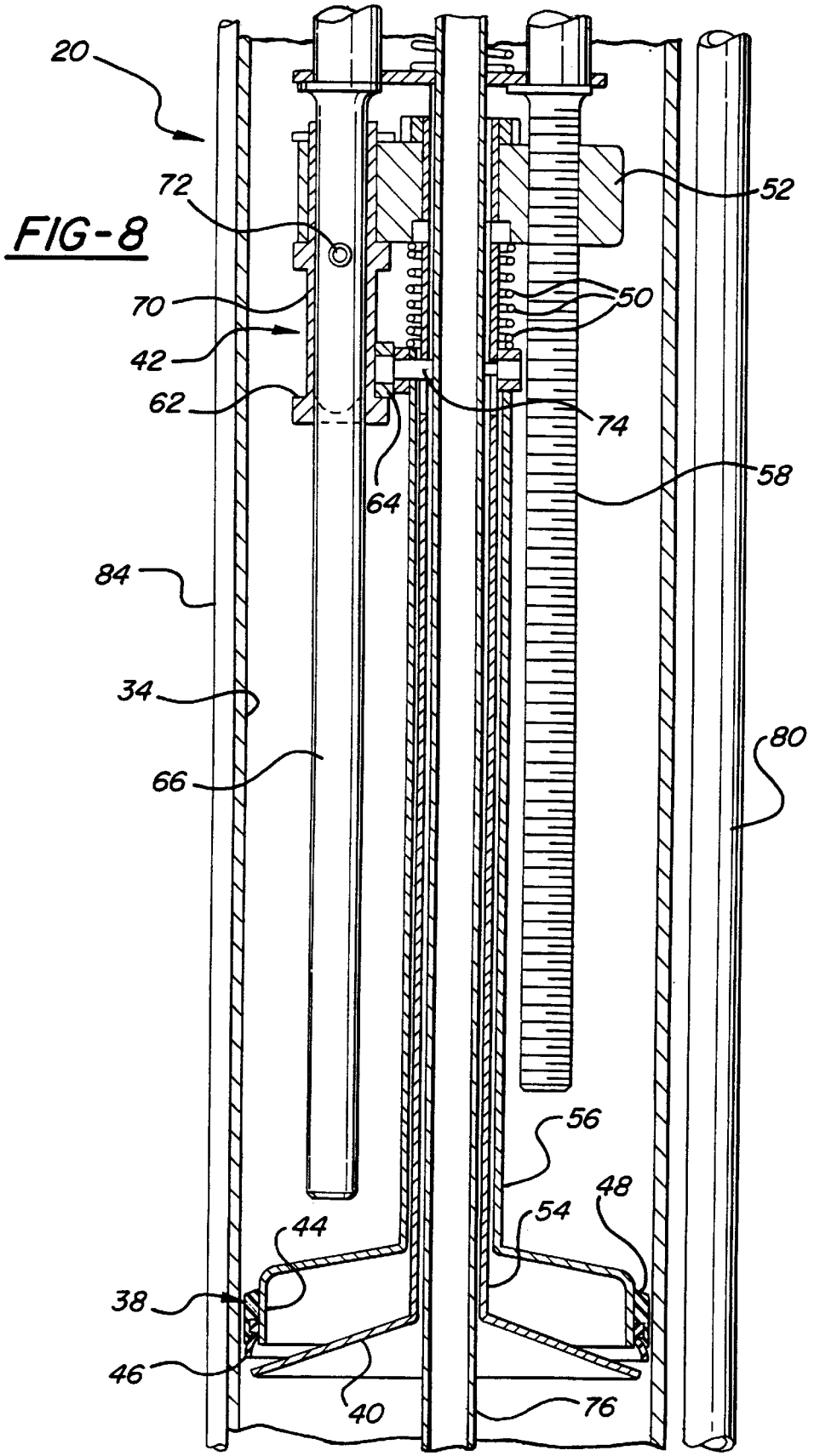
FIG. 8 is an enlarged fragmentary and cross sectional view of the filling unit and showing the adjustment valve of the subject assembly in the open position.

The filling machine 10 is characterized by an adjustment valve for determining the quantity of the material 14 to be filled into the chamber 34 by preventing the flow of material upwardly past the valve and for allowing cleaning material 37 to flow downwardly past the valve. As best shown in FIGS. 7 and 8, the valve includes a seal generally indicated at 38 and movable between a closed position in sealing engagement with the chamber 34, as shown in FIG. 7, and an open position spaced from the chamber 34 to allow flow there past, as shown in FIG. 8. The valve also includes a positioning member 40 for holding the seal 38 in the closed position, as shown in FIG. 7.

Figure 6:
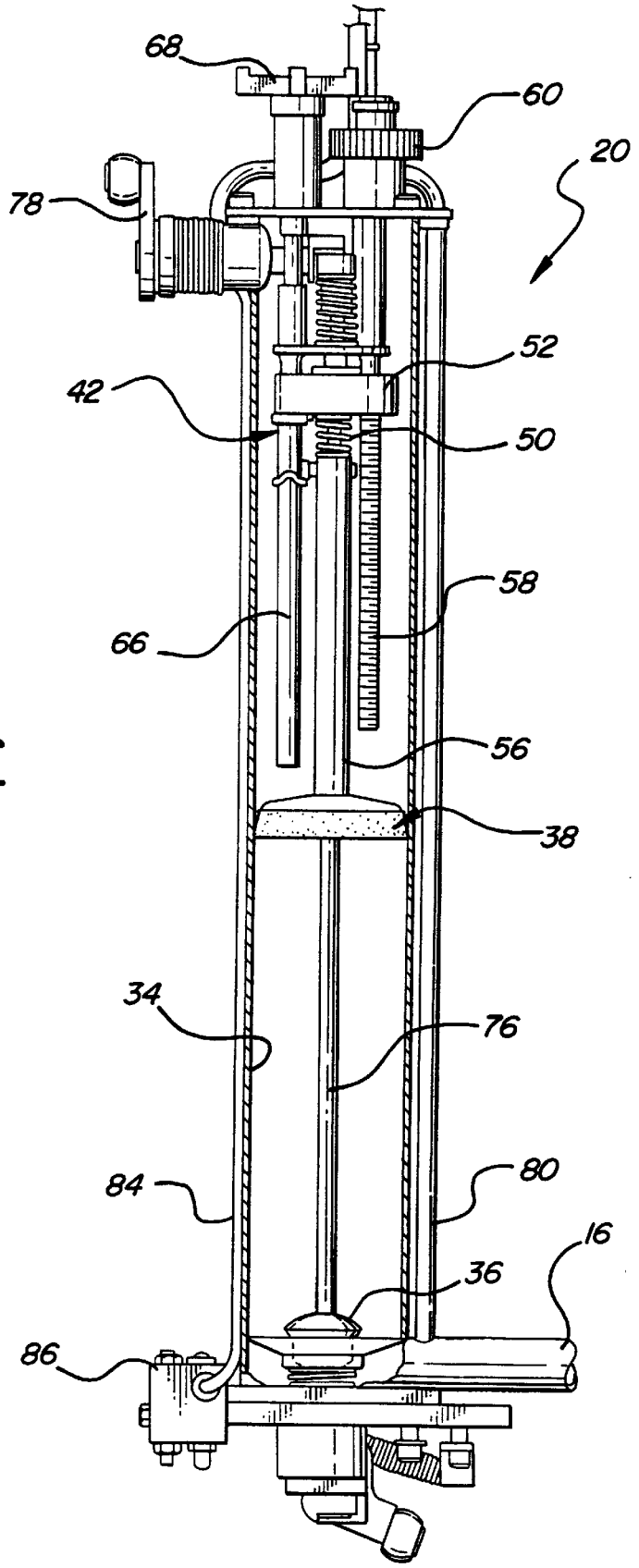
FIG. 6 is an enlarged view of the filling unit.

The valve also includes an actuator mechanism, generally shown at 42 in FIGS. 6, 7 and 8, for effecting relative movement between the seal 38 and the positioning member 40 for controlling the relative movement between the open and closed positions. The actuator mechanism 42 includes a cylindrical support skirt 44 disposed in parallel and in spaced relationship to the interior wall of the chamber 34. The chamber 34 is circular in cross section and the seal 38 extends annularly about the support skirt 44. The seal 38 is disposed about the support skirt 44 in the space between the support skirt 44 and the interior wall of the chamber 34. The seal 38 comprises a lip seal 46 and a positioning seal 48. The support skirt 44 presents a lower periphery and the lip seal 46 includes a lip depending below the periphery of the support skirt 44. The positioning member 40 engages the lip seal 46 and moves the lip seal 46 outwardly against the chamber 34 in the closed position. The positioning seal 48 is adhesively or otherwise secured to the skirt 44 and is of a firmer or harder material than the lip seal 46 so as to act as back seal to the softer lip seal 46.

The positioning member 40 is disposed below and extends radially outwardly of the periphery of the support skirt 44 to wedge or compress the lip seal 46 into engagement with the chamber 34 in the closed position. The positioning member 40 actually engages the periphery of the support skirt 44 in the closed position. The positioning member 40 is conical in shape and the support skirt 44 is dome shaped.

The actuator mechanism 42 includes a biasing means comprising a coiled spring 50 for biasing the support skirt 44 and the positioning member 40 toward one another to the closed position. The actuator mechanism 42 includes a platform 52 disposed in the chamber 34, a first column 54 interconnecting the platform 52 and the positioning member 40, and a second column 56 connected to the support skirt 44. The biasing means reacts between the platform 52 and the second column 56 to urge the skirt 44 into engagement with the positioning member 40. A first actuator 58 is included for moving the platform 52 vertically in the chamber 34 to adjust the vertical position of the valve. The first actuator 58 comprises a threaded shaft in threaded engagement with the platform 52 for moving the platform 52 vertically in response to rotation of the threaded shaft and the threaded shaft is rotated by a gear 60 in driving engagement with a belt or another gear.

The actuator mechanism 42 also includes a second actuator, comprising a cam 62 and a cam follower 64, for moving the second column 56 vertically relative to the first column 54 against the biasing spring 50 to the open position. The cam follower 64 extends radially from the second column 56 and the cam 62 is rotatably supported by the platform 52 and in engagement with the cam follower 64. More specifically, a shaft 66 extends downwardly from a wheel 68 and a cam sleeve 70 is non-rotatably secured to the shaft 66 by a pin 72, with the sleeve 70 rotatably supported by the platform 52. The cam 62 has an undulating or sinusoidal surface in the direction of the axis of rotation thereof to raise and lower the cam follower 64. The wheel 68 is rotated to rotate the cam 62 which raises and lowers the cam follower 64, the cam follower 64 comprising a roller rolling along the cam 62. The wheel 68 is rotated by one of the actuator stations 30 or manually. A pin 74 supports the cam follower 64 and extends through a slot in the first column 54 to prevent relative rotation between the first 54 and second 56 columns.

A hollow mast 76 is supported within the chamber 34 and the first column 54 comprises a first tube surrounding the mast 76 for vertical sliding movement thereon and the second column 56 comprises a second tube surrounding the first tube for vertical sliding movement thereon.

Figure 2:
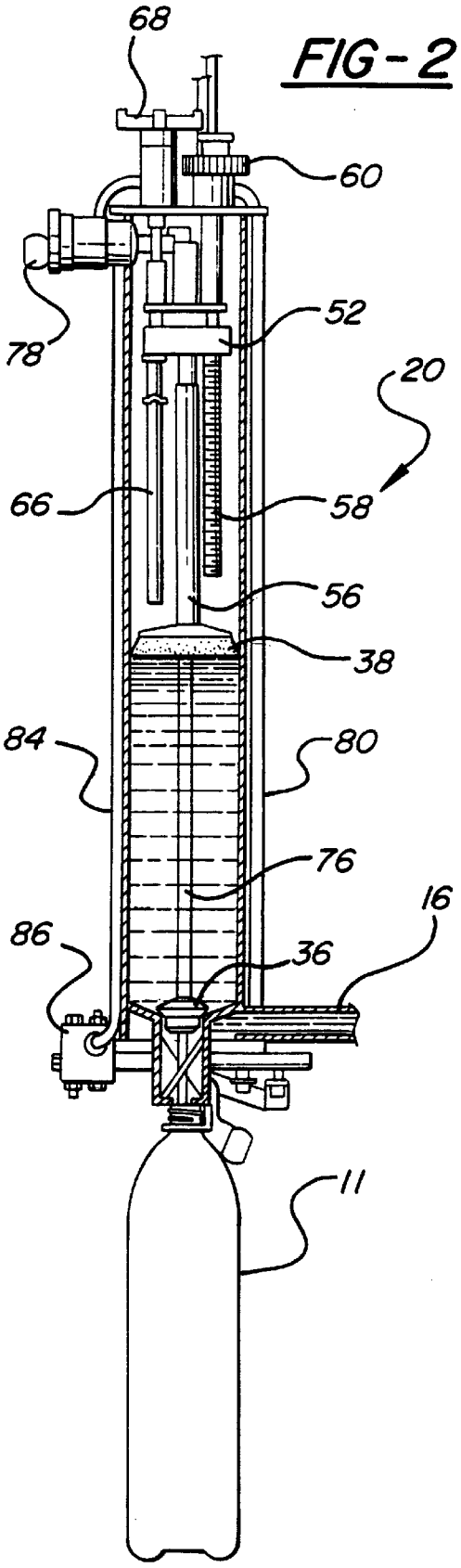
FIG. 2 is a cross sectional view of the filling unit of the subject invention with the chamber charged with material to fill a container.
Figure 3:
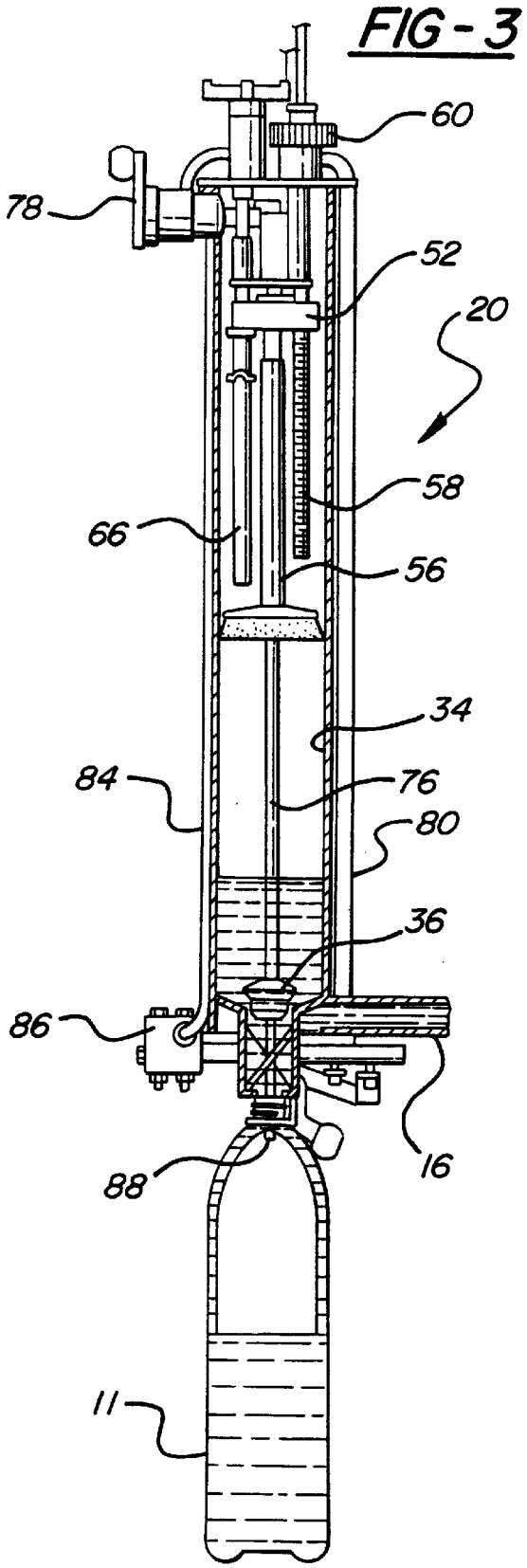
FIG. 3 is a view like FIG. 2 but showing the container being filled.
Figure 4:
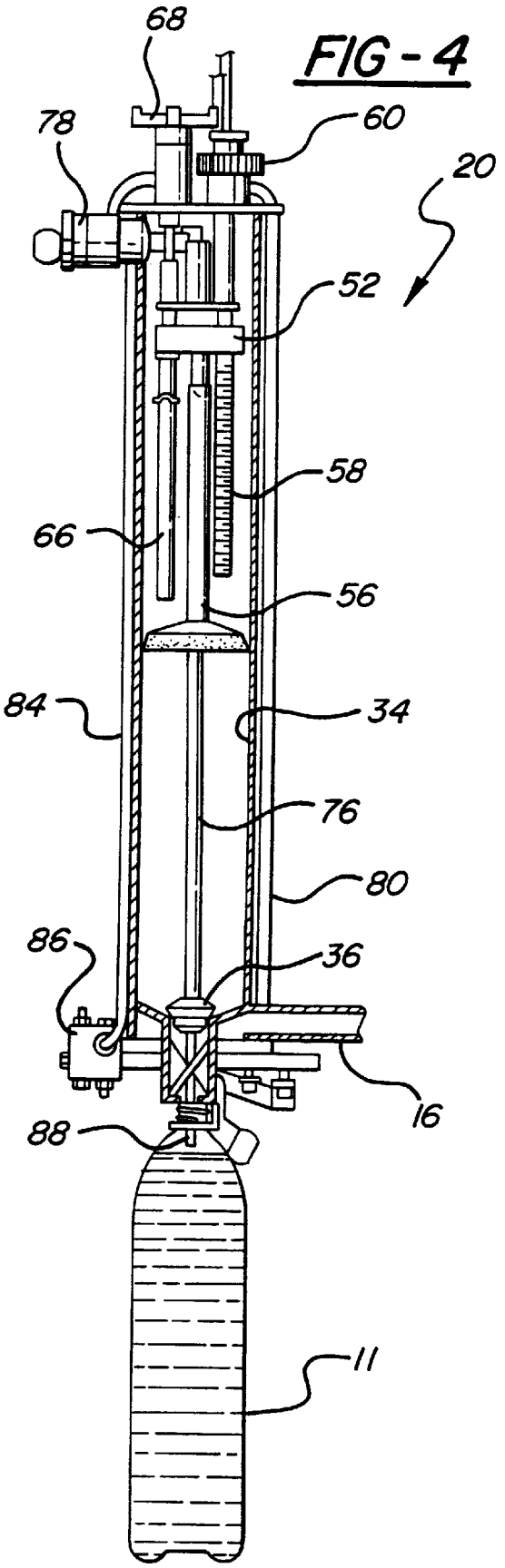
FIG. 4 is a view like FIGS. 2 and 3 but showing the container completely filled.
Figure 5:
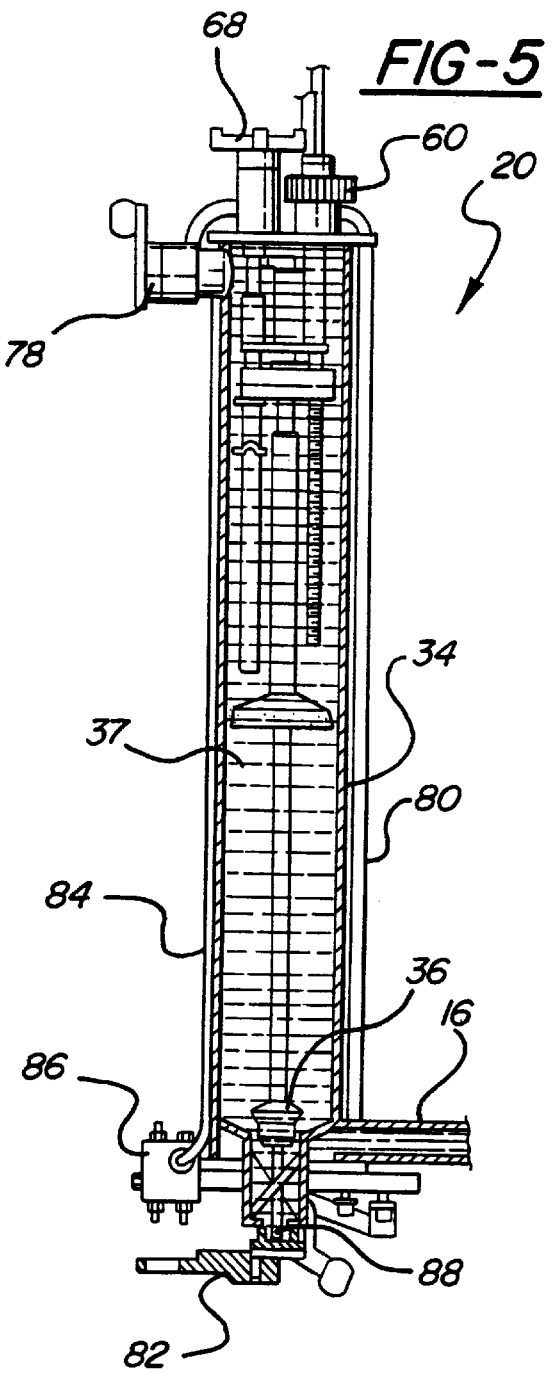
FIG. 5 is view like FIGS. 2, 3 and 4 but showing the chamber being cleaned with cleaning fluid flowing top to bottom of the chamber.

The container filling mechanism 36 includes a vertically movable poppet valve attached to the mast 76 and a third actuator 78 moves the mast 76 vertically to open and close the poppet valve. The third actuator 78 comprises an arm which is rotated at an actuation station between the closed positions shown in FIGS. 2 and 4 and the open position shown in FIGS. 1, 3, 5 and 6. A gas line 84 feeds carbon dioxide through a valve 86 to fill the container 11 and the carbon dioxide vents through the vent tube 88 and up through the hollow mast 76. The valve 86 is operated by one of the actuator stations 32.

During initial setup, the gear 60 is rotated to rotate the threaded shaft 58 to adjust the vertical position of the platform 52. Since the adjustment valve depends from the platform 52 via the columns 54 and 56, its vertical position is therefore moved to a predetermined level, which is commensurate with the quantity or volume of the container 11 to be filled during that run or setup. Once a run of a particular beverage material is complete and it is desired to setup for a run of containers 11 of a different size, the gear is again rotated to adjust the vertical position of the adjustment valve in the chamber 34. However, between runs of different beverage materials, whether the container size is changed or not, the machine must be cleaned by flushing cleaning liquid material through the chambers 34. The flushing liquid is introduced either to the top of the chamber 34 by the fluid line 80 or through an open poppet valve 36, or both. In the cleaning position, the poppet valve 36 is opened by rotation of the arm 78 to raise the mast 76. In addition, the wheel 68 is rotated to rotate the cam 62 to lift the seal 38 away from the positioning member 40 via the second column 56. A control valve 82 is disposed at the bottom of the chamber 34 for allowing the dumping of the cleaning liquid from the chamber 34.

Accordingly, the invention also provides a method of cleaning a machine for filling containers comprising the steps of; moving a plurality of chambers 34 through a plurality of actuator stations, filling the chambers 34 through the bottoms thereof, sealing each chamber 34 at a predetermined level to prevent material to fill above the predetermined level, and filling a container from each chamber 34 with the material filled to the predetermined level therein. The method is characterized by periodically unsealing each chamber 34 to allow cleaning material 37 to flow downwardly past the predetermined level for cleaning the chamber 34. The method also includes adjusting the predetermined level to change the quantity of material for filling each container. The sealing and unsealing are further defined as placing a seal 38 about the interior of the chamber 34 and placing a positioning member 40 adjacent thereto and moving the seal 38 and positioning member 40 together to force the seal 38 into sealing engagement with the chamber 34 and moving the seal 38 and positioning member 40 apart to allow the seal 38 to move out of sealing engagement with the chamber 34. A further step is the biasing of the seal 38 and the positioning member 40 together. The adjusting of the predetermined level is further defined as moving the seal 38 and the positioning member 40 in unison.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, wherein reference numerals are merely for convenience and are not to be in any way limiting, the invention may be practiced otherwise than as specifically described.

What is claimed is:

1. A filling machine comprising:

a plurality of individual filling units (20);

a common drive (28) for moving said filling units (20) through a plurality of actuator stations (30 and 32);

each of said filling units (20) including a working chamber (34);

a container filling mechanism (36) at the bottom of each chamber (34);

a supply of material for filling said chamber (34) with material through said filling mechanism (36); and a valve for determining the quantity of the material to be filled into said chamber (34) by preventing the flow of material upwardly past said valve and for allowing cleaning material (37) to flow downwardly past said valve;

and wherein said valve includes a seal (38) movable between a closed position in sealing engagement with said chamber (34) and an open position spaced from said chamber (34) to allow flow there past, said valve includes a positioning member (40) for holding said seal (38) in said closed position, said valve includes an actuator mechanism (42) for effecting relative movement between said seal (38) and said positioning member for controlling said relative movement between said open and closed positions, said actuator mechanism (42) includes a support skirt (44) disposed in parallel and in spaced relationship to said chamber (34), said seal (38) being disposed about said support skirt (44) in the space between said support skirt (44) and said chamber (34).

2. A filling machine as set forth in claim 1 wherein said support skirt (44) presents a lower periphery and said seal (38) depends below said periphery.

3. A filling machine as set forth in claim 2 wherein said positioning member is disposed below and extends radially outwardly of said periphery of said support skirt (44) to wedge said seal (38) into engagement with said chamber (34) in said closed position.

4. A filling machine as set forth in claim 3 wherein said positioning member engages said periphery in said closed position.

5. A filling machine as set forth in claim 4 wherein said seal (38) includes a lip depending below said periphery and said positioning member engages said lip and moves said lip outwardly against said chamber (34) in said closed position.

6. A filling machine as set forth in claim 5 wherein said positioning member is conical and said support skirt (44) is dome shaped.

7. A filling machine as set forth in claim 6 wherein said chamber (34) is circular in cross section and said seal (38) extends annularly about said support skirt (44).

8. A filling machine as set forth in claim 7 wherein said seal (38) comprises a lip seal (46) and a positioning seal (48).

9. A filling machine as set forth in claim 3 wherein said actuator mechanism (42) includes a biasing means for biasing said support skirt (44) and said positioning member to said closed position.

10. A filling machine as set forth in claim 9 wherein said actuator mechanism (42) includes a platform (52) disposed in said chamber (34), a first column (54) interconnecting said platform (52) and said positioning member, a second column (56) connected to said support skirt (44), said biasing means reacting between said platform (52) and said second column (56) to urge said skirt (44) into engagement with said positioning member, and a first actuator (58) for moving said platform (52) vertically in said chamber (34) to adjust the vertical position of said valve.

11. A filling machine as set forth in claim 10 wherein said actuator mechanism (42) includes a second actuator for moving said second column (56) vertically relative to said first column (54) against said biasing means to said open position.

12. A filling machine as set forth in claim 11 wherein said first actuator (58) comprises a threaded shaft in threaded engagement with said platform (52) for moving said platform (52) vertically in response to rotation of said threaded shaft.

13. A filling machine as set forth in claim 12 wherein said second actuator comprises a cam follower (64) extending radially from said second column (56), a cam (62) rotatably supported by said platform (52) and in engagement with said cam follower (64).

14. A filling machine as set forth in claim 13 including a mast (76) supported within said chamber (34), and wherein said first column (54) comprises a first tube surrounding said mast (76) for vertical sliding movement thereon and said second column (56) comprises a second tube surrounding said first tube for vertical sliding movement thereon.

15. A filling machine as set forth in claim 14 wherein said container filling mechanism (36) includes a poppet valve attached to said mast (76), and including a third actuator for moving said mast (76) vertically to open and close said poppet valve.

16. A filling machine comprising:

a plurality of individual filling units (20);

a common drive (28) for moving said filling units (20) through a plurality of actuator stations (30 and 32);

each of said filling units (20) including a working chamber (34);

a container filling mechanism (36) at the bottom of each chamber (34);

a supply of material for filling said chamber (34) with material through said filling mechanism (36); and a valve for determining the quantity of the material to be filled into said chamber (34) by preventing the flow of material upwardly past said valve and for allowing cleaning material (37) to flow downwardly past said valve said, valve includes a seal (38) movable between open and closed positions and a positioning member; wherein said actuator mechanism (42) includes a platform (52) disposed in said chamber (34), and including a first column (54) interconnecting said platform (52) and said positioning member, a second column (56) connected to said seal (38), and a first actuator (58) for moving said platform (52) vertically in said chamber (34) to adjust the vertical position of said valve.

17. A filling machine as set forth in claim 16 wherein said actuator mechanism (42) includes a second actuator for moving said second column (56) vertically relative to said first column (54) to move said seal (38) to said open position for allowing cleaning material (37) to flow downwardly past said seal (38).

18. A filling machine as set forth in claim 17 wherein said first actuator (58) comprises a threaded shaft in threaded engagement with said platform (52) for moving said platform (52) vertically in response to rotation of said threaded shaft.

19. A filling machine as set forth in claim 18 wherein said second actuator comprises a cam follower (64) extending radially from said second column (56), a cam (62) rotatably supported by said platform (52) and in engagement with said cam follower (64), said first and second actuators being actuated at said actuator stations.

20. A filling machine as set forth in claim 19 including a mast (76) supported within said chamber (34), and wherein said first column (54) comprises a first tube surrounding said mast (76) for vertical sliding movement thereon and said second column (56) comprises a second tube surrounding said first tube for vertical sliding movement thereon.

* * * * *